US009190786B1

(12) United States Patent
Baumler

(10) Patent No.: US 9,190,786 B1
(45) Date of Patent: Nov. 17, 2015

(54) MODULAR RF CONNECTOR SYSTEM

(71) Applicant: Robert J. Baumler, Waseca, MN (US)

(72) Inventor: Robert J. Baumler, Waseca, MN (US)

(73) Assignee: Cinch Connectivity Solutions Inc., Bannockburn, IL (US)

( * ) Notice: Subject to any disclaimer, the term of this patent is extended or adjusted under 35 U.S.C. 154(b) by 0 days.

(21) Appl. No.: 14/121,713

(22) Filed: Oct. 10, 2014

Related U.S. Application Data

(63) Continuation of application No. 13/815,759, filed on Mar. 15, 2013, now Pat. No. 8,888,519.

(60) Provisional application No. 61/689,187, filed on May 31, 2012.

(51) Int. Cl.
*H01R 9/05* (2006.01)
*H01R 24/54* (2011.01)

(52) U.S. Cl.
CPC ..... *H01R 24/542* (2013.01)

(58) Field of Classification Search
CPC ..... H01R 9/05
USPC ..... 439/247, 248, 63, 578, 581
See application file for complete search history.

(56) References Cited

U.S. PATENT DOCUMENTS 3,094,364 A * 6/1963 Liagg ..... H01R 13/629 285/154.1
3,673,546 A 6/1972 Green et al.
4,227,765 A 10/1980 Neumann et al.
4,580,862 A * 4/1986 Johnson ..... H01R 24/52 439/248
4,697,859 A 10/1987 Fisher, Jr.
4,792,312 A * 12/1988 Yasumoto ..... H01R 31/06 439/164
4,815,986 A 3/1989 Dholoo
4,867,707 A 9/1989 Widdoes
4,906,207 A 3/1990 Banning et al.
4,925,403 A * 5/1990 Zorzy ..... H01R 13/6315 439/578
5,026,302 A 6/1991 Spencer
5,167,520 A 12/1992 Henry et al.
5,516,303 A 5/1996 Yohn et al.

(Continued)

FOREIGN PATENT DOCUMENTS

JP 08-017521 A 1/1996
JP 2002-365485 A 12/2002

(Continued)

OTHER PUBLICATIONS

International Search Report, Dec. 5, 2013, PCT/US2013/042873 filed May 28, 2013, pp. 3-4.

*Primary Examiner* — Neil Abrams
(74) *Attorney, Agent, or Firm* — Karl D. Kovach

(57) ABSTRACT

The electrical connector or device includes a first center contact, a first outer conductor, a first insulation material, a second center contact, a second outer conductor, a second insulation material, a spring, and a flexible wire. The first center contact has a longitudinal axis. The first insulation material is retained between the first center contact and the second outer conductor. The second center contact has a longitudinal axis. The second insulation material is retained between the second center contact and the second outer conductor. The longitudinal axis of the second center contact is substantially perpendicular to the longitudinal axis of the first center contact. The spring is in contact with the first outer conductor and the second outer conductor. The flexible wire is attached to the first center contact and the second center contact.

7 Claims, 13 Drawing Sheets

(56) References Cited

U.S. PATENT DOCUMENTS 5,562,464 A 10/1996 Lecourtois
5,641,294 A 6/1997 Beard
5,769,652 A 6/1998 Wider
5,785,534 A 7/1998 Longueville et al.
5,823,823 A 10/1998 Longueville et al.
5,893,761 A 4/1999 Longueville
6,012,927 A 1/2000 Longueville et al.
6,113,431 A 9/2000 Wong
6,250,960 B1 6/2001 Youtsey
6,267,621 B1 * 7/2001 Pitschi et al. ..... H01R 24/564 439/578
6,276,970 B1 8/2001 Wong
6,296,518 B1 10/2001 Avery et al.
6,497,579 B1 12/2002 Garbini
6,506,069 B2 * 1/2003 Babala ..... G01L 19/003 439/248
6,547,593 B1 4/2003 Beckous
6,572,406 B2 6/2003 Guidet
6,575,761 B1 6/2003 Regnier
6,692,262 B1 2/2004 Loveless
6,695,646 B1 2/2004 Grabbe
6,699,054 B1 3/2004 Critelli
6,705,875 B2 3/2004 Berghorn et al.
6,709,289 B2 3/2004 Huber et al.
6,827,608 B2 * 12/2004 Hall ..... H01R 13/6315 439/578
6,988,912 B2 1/2006 Bourgeas et al.
7,086,866 B1 8/2006 Folan et al.
7,097,505 B1 8/2006 Shanahan et al.
7,112,078 B2 * 9/2006 Czikora ..... H01R 13/6315 439/248
7,179,121 B1 2/2007 Burris et al.
7,186,139 B2 * 3/2007 Chen ..... H01R 24/44 439/541.5
7,217,160 B2 5/2007 Hsu
7,335,058 B1 2/2008 Burris et al.
7,351,105 B2 4/2008 Delaney et al.
7,416,415 B2 8/2008 Hart et al.
7,458,850 B1 12/2008 Burris et al.
7,478,475 B2 1/2009 Hall
7,527,500 B2 5/2009 Montena
7,544,093 B2 6/2009 Soubh et al.
7,563,133 B2 7/2009 Stein
7,699,617 B2 * 4/2010 Benham ..... H01R 23/688 439/63
7,717,716 B2 5/2010 Dahms
7,753,744 B2 7/2010 Zaderej et al.
7,811,139 B1 10/2010 Parikh et al.
7,841,882 B2 11/2010 Antonini et al.
7,874,845 B1 1/2011 Tang et al.
7,927,125 B1 4/2011 Zieman et al.
7,938,654 B2 5/2011 Stein
8,016,614 B2 * 9/2011 Xie ..... H01R 13/6315 439/578
8,043,127 B2 10/2011 Bailey et al.
8,079,882 B2 12/2011 Bailey et al.
8,123,560 B2 2/2012 McAlonis et al.
8,221,161 B2 7/2012 Leibfried, Jr.
8,231,398 B2 * 7/2012 Rosenberger ..... H01R 13/6315 248/675
8,282,415 B1 10/2012 Foltz et al.
8,496,495 B2 7/2013 Kari
8,597,050 B2 * 12/2013 Flaherty ..... H01R 13/6277 439/578
8,801,459 B2 * 8/2014 Mrowka ..... H01R 24/54 439/246
8,888,519 B2 * 11/2014 Baumler ..... H01R 24/542 439/248
2001/0027033 A1 10/2001 Fujimoto et al.
2004/0229512 A1 11/2004 Chen
2006/0178047 A1 8/2006 Croan
2012/0295478 A1 11/2012 Mrowka

FOREIGN PATENT DOCUMENTS

KR 20-0189845 Y1 7/2000
KR 10-2004-0023415 A 3/2004
KR 10-2005-0058436 A 6/2005
KR 20-2009-0008231 U 8/2009
KR 10-1049171 B1 7/2011
WO WO 2011-088902 A1 7/2011

* cited by examiner

MODULAR RF CONNECTOR SYSTEM

This is a continuation of U.S. patent application Ser. No. 13/815,759, filed Mar. 15, 2013. U.S. patent application Ser. No. 13/815,759 claims the priority of earlier filed U.S. Provisional Application Ser. No. 61/689,187, filed May 31, 2012. Thus, this non-provisional, continuation application claims the priority of earlier filed U.S. patent application Ser. No. 13/815,759, filed on Mar. 15, 2013, and earlier filed U.S. Provisional Application Ser. No. 61/689,187, filed May 31, 2012. U.S. patent application Ser. No. 13/815,759, and U.S. Provisional Application Ser. No. 61/689,187 are hereby incorporated herein by reference.

BACKGROUND OF THE INVENTION

1. Field of the Invention

The present invention pertains to electrical connectors. The invention more particularly concerns electrical connectors, such as coaxial connectors, which transmit electrical signals in the radio frequency (RF) range or spectrum.

2. Discussion of the Background

Electrical connectors which operate in the RF spectrum are known. As the number of transmitted electrical signals increases the number of electrical connectors increases. However, in some applications, the amount of space available to accommodate the electrical connectors has not increased. Thus, the density per unit space of connectors is increased. The density can be increased, but the increase in density is limited by how closely the human fingers can install one electrical connector next to a previously installed electrical connector.

Also known in the art are ganged connectors, such as the connector disclosed in U.S. Pat. No. 7,927,125, which is hereby incorporated herein by reference. This connector has a predefined number of electrical ports that can be accommodated. If the number of desired ports exceeds the number of ports provided on the connector, then another connector must be used or a special connector must be made.

SUMMARY OF THE INVENTION

It is an object of the invention to provide a device which is easily connectable since the device is tolerant of misalignment between connectors.

It is another object of the invention to provide a device which increases the number of connectors present per unit area.

In one form of the invention the device includes a first center contact, a first outer conductor, a first insulation material, a second center contact, a second outer conductor, a second insulation material, a spring, and a flexible wire. The first center contact has a longitudinal axis and is electrically conductive. The first outer conductor is electrically conductive. The first insulation material is made of a non-electrically conductive material. The first insulation material is retained between the first center contact and the second outer conductor. The second center contact has a longitudinal axis and is electrically conductive. The second outer conductor is electrically conductive. The second insulation material is made of a non-electrically conductive material. The second insulation material is retained between the second center contact and the second outer conductor. The longitudinal axis of the second center contact is substantially perpendicular to the longitudinal axis of the first center contact. The spring is in contact with the first outer conductor and the second outer conductor. The spring is a spring washer. The flexible wire is attached to the first center contact and the second center contact. The flexible wire conducts electricity. The first center contact is in electrical communication with the second center contact via the flexible wire. When a force is applied to the first outer conductor, the force is reacted through the spring to the second outer conductor and no through the flexible wire, and, in response to the force, the spring is compressed.

In still yet another form of the invention the device includes a first connector, a second connector, and an adaptor. The first connector includes a center contact, an outer conductor, and a layer of insulation material. The center contact and the outer conductor of the first connector are separated by the layer of insulation material. The outer conductor of the first connector includes an inner annular projection. The second connector includes a center contact, an outer conductor, and a layer of insulation material. The center contact and the outer conductor of the second connector are separated by the layer of insulation material. The outer conductor of the second connector includes an annular region formed within a recess of the outer conductor. The adaptor includes a central contact, an outer conductor, and a layer of insulation material. The layer of insulation material is retained between the central contact and the outer conductor of the adaptor. The outer conductor of the adaptor includes a first leg and a second leg. The first leg of the outer conductor of the adaptor having a contact surface and a flared end, and the second leg of the outer conductor of the adaptor having a nub. The central contact of the adaptor includes two female contacts, and where one of the two female contacts includes a contact surface. When the adaptor engages the second connector, the nub of the second leg of the outer conductor of the adaptor engages the annular region formed in the recess of the outer conductor of the second connector so as to retain the adaptor by the second connector. Then, when the adaptor is introduced to the first connector, the flared end of the first leg of the outer conductor of the adaptor being aligned about the inner annular projection of the outer conductor of the first connector and the contact surface of the first leg of the outer conductor of the adaptor contacts the inner annular projection of the outer conductor of the first connector. Still further, when the adaptor is further introduced toward the first connector, the contact surface of the first leg of the outer conductor remains in contact with the inner annular projection of the outer conductor of the first connector, and the contact surface of the first female contact of the two female contacts of the central conductor of the adaptor contacts the center contact of the first connector.

Thus, the invention achieves the objectives set forth above. The invention provides a device which is able to be tolerant of misalignment between two connectors coming together to be connected, and the invention provides a device which increases the port density of connectors per unit area. Additionally, the invention provides for a RF electrical connector which can be configured to a variety of mounting styles.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PRESENTLY PREFERRED EMBODIMENTS

Figure 1:
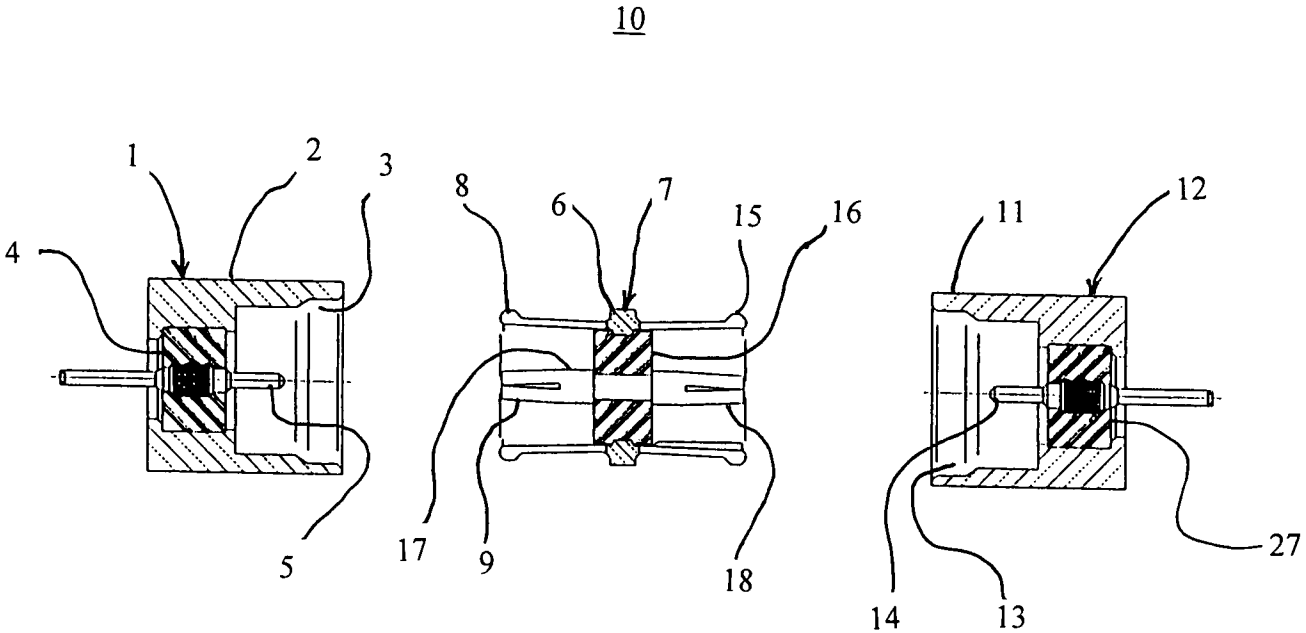
FIG. 1 is a cross-sectional side view of a first embodiment of the electrical connector including a first connector, an adaptor, and a second connector of the invention.

Referring now to the drawings, wherein like reference numerals designate identical or corresponding parts through the several views, embodiments of the present invention are displayed therein.

FIG. 1 is a cross-sectional side view of the first embodiment of the electrical connector of the invention. The connector assembly 10 is a 75 Ohm SMP style connector which includes a first connector 1, an adaptor 7, and a second connector 12. The first connector 1 includes an electrically conductive outer conductor 2, a layer of insulation material 4, and a center contact 5 which is electrically conductive. The layer of insulation material 4 retains the center contact 5, and the layer of insulation material is retained by the outer conductor 2. The outer conductor 2 forms a recess 3. The center contact 5 is electrically isolated from the outer conductor 2 by the layer of insulation material 4. The center contact 5 is a male contact.

The second connector 12 of FIG. 1 is similar to the first connector 1. The second connector 12 includes an electrically conductive outer conductor 11, a layer of insulation material 27, and a center contact 14. The outer conductor 11 forms a recess 13.

The adapter 7 includes a conductive outer conductor 6, a layer of insulation material 16, and a center contact 17. The outer conductor 7 includes legs 8 and 15, and the center contact 17 includes female contacts 9, 18 at each end. The outer conductors 2, 6, 11, the center contacts 5, 17, 14, and the layers of insulation material 4, 16, 27 are made of suitable engineering materials.

In use, when the first connector 1 is fully engaged with the adapter 7, and the second connector 12 is fully engaged with the adaptor 7, the contact 9 of the adaptor 7 is engaged with the contact 5 of the first connector 1, the contact 18 of the adaptor 7 is engaged with the contact 14 of the second connector 12, the leg 8 of the outer conductor 6 of the adaptor 7 is engaged with a surface of the recess 3 of the outer conductor 2 of the first connector 1, and the leg 15 of the outer conductor 6 of the adaptor 7 is engaged with a surface of the recess 13 of the outer conductor 11 of the second connector 12. In this engagement, the outer conductor 2 of the first connector 1 is in electrical communication with the outer conductor 11 of the second connector 12 via the outer conductor 6 of the adapter 7, and the central contact 5 of the first connector 1 is in electrical communication with the central contact 14 of the second connector 12 via the central contact 17 of the adaptor 7.

Figure 2:
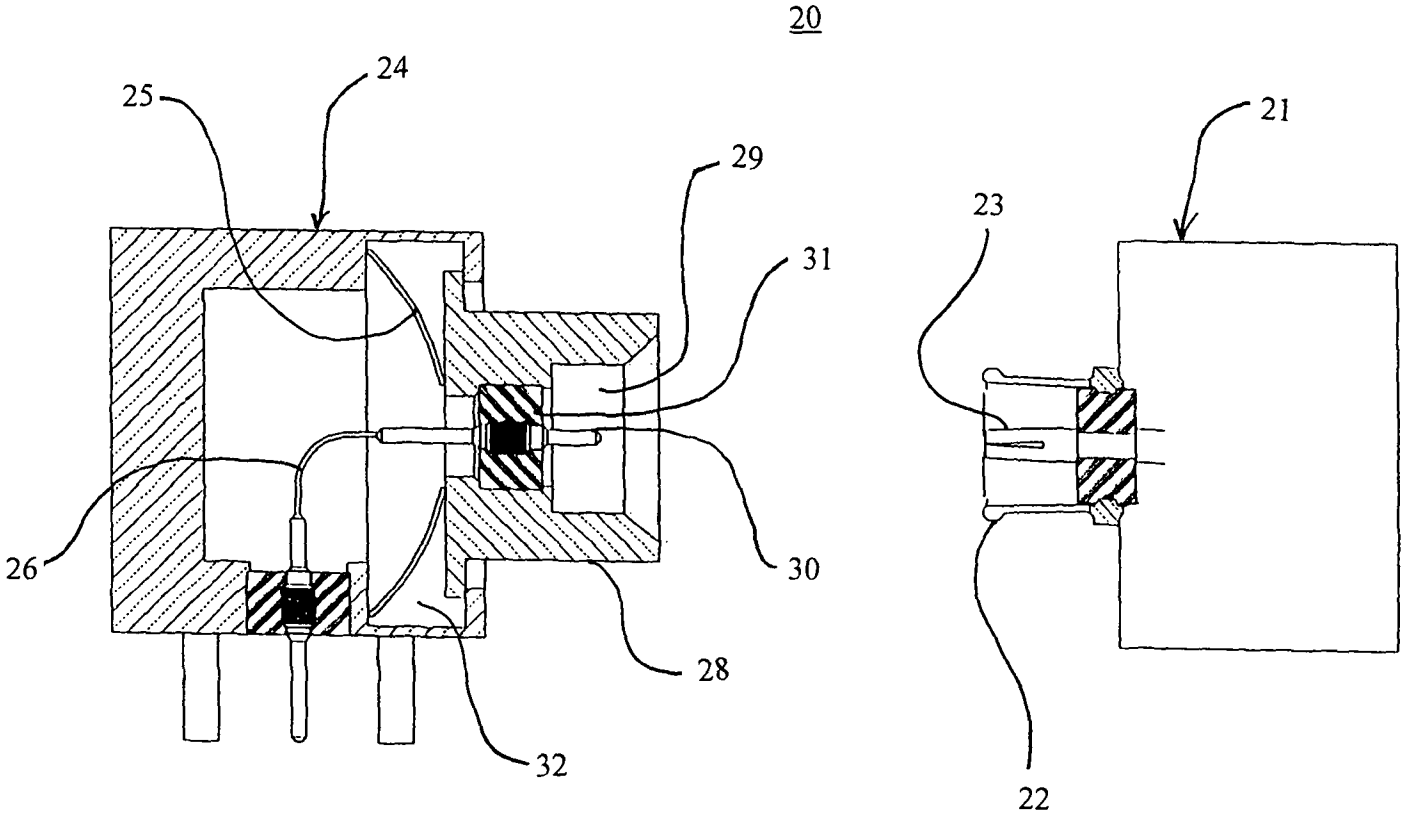
FIG. 2 is a cross-sectional side view of a second embodiment of the electrical connector of the invention.

FIG. 2 is a cross-sectional side view of the second embodiment of the electrical connector of the invention. The connector assembly 20 includes a floating nose style 75 Ohm SMP style connector 24 which is mateable to connector 21. The floating nose connector 24 includes an outer conductor 28, a layer of insulation material 31, and a center contact 30. The center contact 30 is attached to a flexible wire 26. The center contact 30 is in electrical communication with the flexible wire 26. The outer conductor 28 includes a recess 29 so as to accommodate an outer conductor 22 of the connector 21. The outer conductor 28 is in contact with a spring washer 25. The spring washer 25 is retained within a recess 32 of the connector 24. The outer conductors 28, 22, the center contacts 30, 23, and the layers of insulation material 31 are made of suitable engineering materials.

In use, when the connector 21 is mated to the connector 24, the two connectors 21, 24 may be somewhat misaligned relative to each other. As the outer conductor 22 of connector 21 is introduced into the recess 29 of the outer conductor 28 of connector 24, if the two connectors 21, 24 are misaligned, then the two connectors will not mate, but instead as the connector 21 is further introduced to connector 24, the spring washer 25 will become compressed which will allow the outer conductor 28 to float and to re-align itself so that the outer conductor 22 of connector 21 will be fully engaged with a surface of the recess of the outer conductor 28 of the connector 24, and, likewise, a female central contact 23 of connector 21 will be fully engaged with the male central contact 30 of connector 24.

Figure 3:
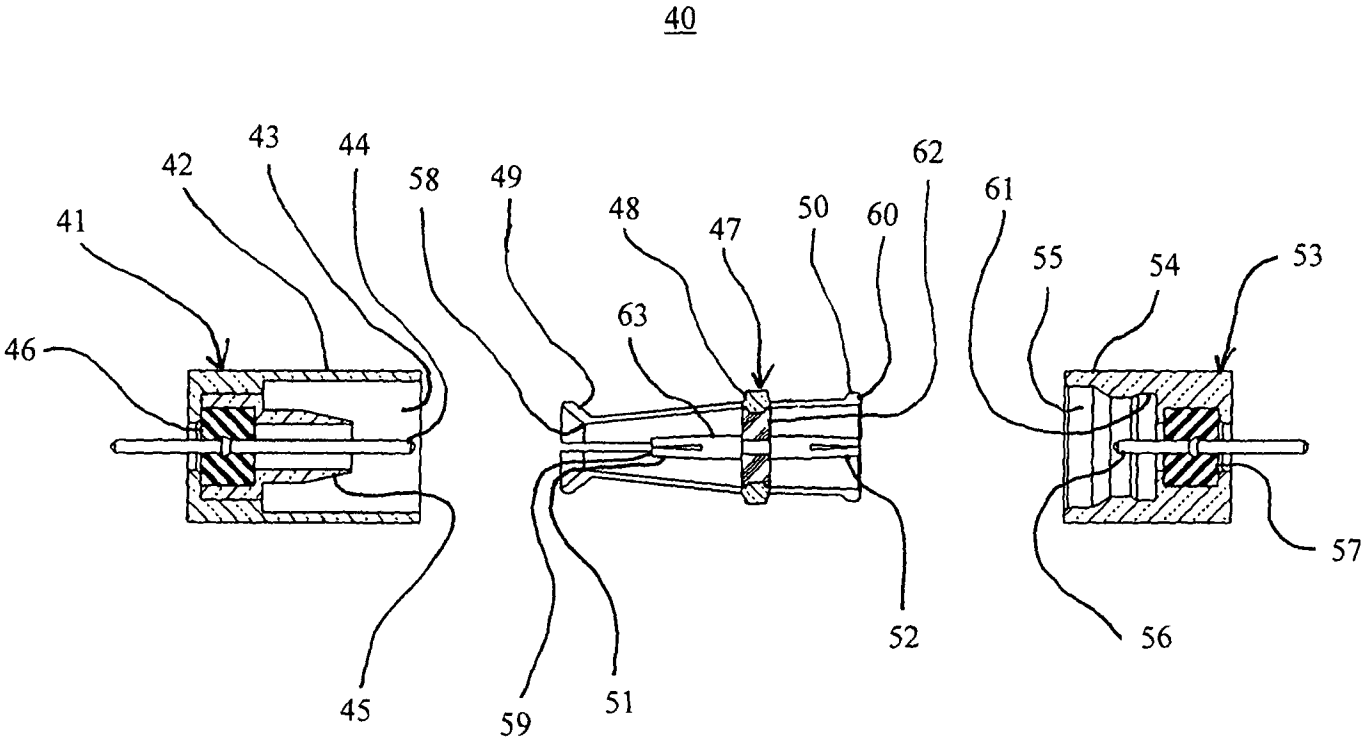
FIG. 3 is a cross-sectional side view of a third embodiment of the electrical connector including a first connector, an adaptor, and a second connector of the invention.

FIG. 3 is a cross-sectional side view of the third embodiment of the electrical connector of the invention. The connector assembly 40 includes a first connector 41, an adaptor 47, and a second connector 53. The first connector 41 includes an outer conductor 42, a layer of insulation, and a center contact 44. The outer conductor 42 includes a recess 43. The outer conductor 42 includes an inner annular projection 45 in the recess 43. The inner annular projection 45 is retained by the outer conductor 42. The outer conductor 42 and the inner annular projection 45 are in electrical communication. The layer of insulation material 46 is retained between the inner annular projection 45 and the center contact 44. The center contact 44 is not in electrical communication with the outer conductor 42 including the inner annular projection 45.

The second connector 53 of FIG. 3 includes an outer conductor 54, a layer of insulation material 57, and a center contact 56. The outer conductor 54 forms a recess 55. The recess 55 includes an annular region 61. The layer of insulation material 57 is retained between the outer conductor 54 and the center contact 56. The center contact 56 is not in electrical communication with the outer conductor 54.

The adaptor 47 includes a conductive outer conductor 48, a layer of insulation material 62, and an central contact 63. The outer conductor 48 includes legs 50, 49. Leg 50 includes a nub 60. The leg 49 includes a contact surface 58. The center contact 63 includes two female contacts 51, 52. Female contact 51 includes a contact surface 59 at its terminal end. The outer conductor 48 is not in electrical communication with the center contact 63. The layer of insulation material 62 is retained between the outer conductor 48 and the center contact 63. The outer conductors 42, 48, 54, the center contacts 44, 63, 56, and the layers of insulation material 46, 62, 57 are made of suitable engineering materials.

Figure 4:
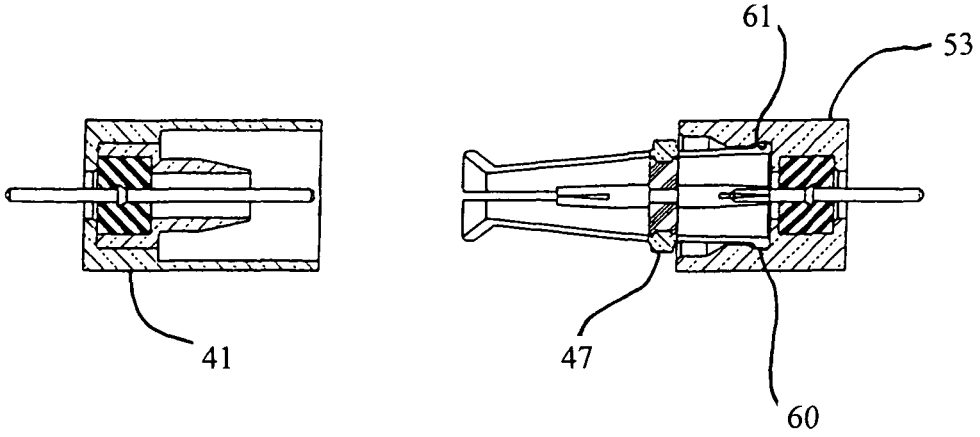
FIG. 4 is a cross-sectional side view of the third embodiment of the invention of FIG. 3 where the adaptor is engaged with the second connector.

In use, the adaptor 47 is urged toward the second connector 53. Eventually, the adaptor 47 is fully engaged with the second connector 53 so that the nub 60 of the leg 50 of the outer conductor 48 of the adaptor 47 is resting in the annular region 61 of the recess 55 of the outer conductor 54 of the second connector 53, and the female contact 52 of the adaptor 47 is fully engaged with the center contact 56 of the second connector 53. The outer conductor 54 of the second connector 53 is in electrical communication with the outer conductor 48 of the adaptor 47, and the central contact 56 of the second connector 53 is in electrical communication with the female contact 52 of the central contact 63 of the adaptor 47, as shown in FIG. 4.

Figure 5:
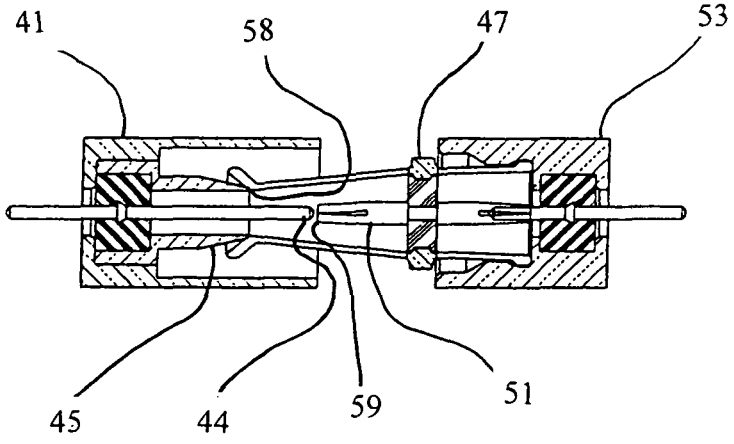
FIG. 5 is a cross-sectional side view of the third embodiment of the invention of FIG. 4 where the adaptor has initially engaged the first connector.

The first connector 41 is then urged toward the adaptor 47. Eventually, the contact surface 58 of the leg 49 of the outer conductor 48 of the adaptor 47 makes physical and electrical contact with the inner annular projection 45 of the outer conductor 42 of the first connector 41, as shown in FIG. 5. At that instance, note that the center contact 44 of the first connector 41 has not yet made contact with the contact surface 59 of the female contact 51 of the center contact 63 of the adaptor 47. The flared ends of the legs 49 of the adaptor 47 and the conical shape of the inner annular projection 45 of the first connector 41 help to align the two bodies for further engagement. Additionally, the tapering of the connector interface helps the connector assembly to self-compensate for impedance change as the connector assembly is unmated. This feature also allows for greater axial float than normal without significant loss in performance.

Figure 6:
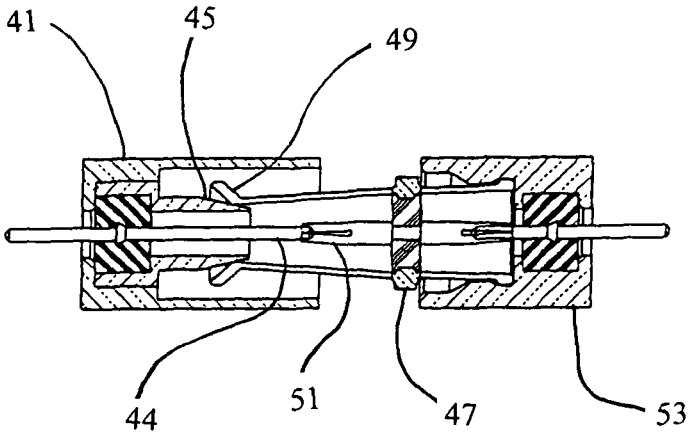
FIG. 6 is cross-sectional side view of the third embodiment of the invention of FIG. 5 where the center conductor of the adaptor has initially engaged the center conductor of the first connector.

The first connector 41 is then continued to be urged toward the adaptor 47. Eventually, the center contact 44 of the first connector 41 makes physical and electrical contact with the contact surface 59 of the female contact 51 of the center contact 63 of the adaptor 47, as shown in FIG. 6. At that moment, as shown in FIG. 6, the contact surface 58 of the leg 49 of the outer conductor 48 of the adaptor 47 is shown to be further along the surface of the inner annular projection 45 of the first connector 41 as compared to its previous position as shown in FIG. 5.

Figure 7:
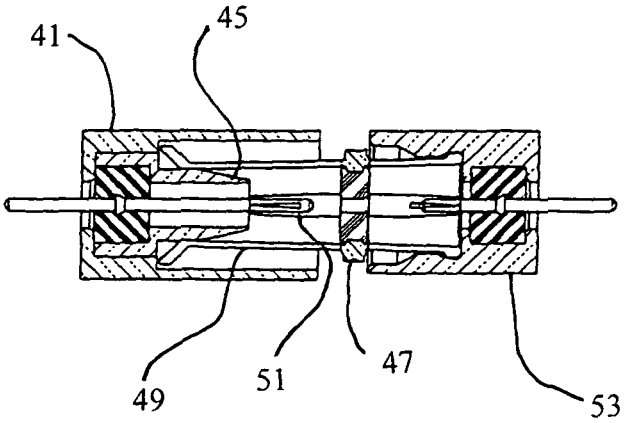
FIG. 7 is a cross-sectional side view of the third embodiment of the invention of FIG. 6 where the first connector is fully engage with the adaptor, and the adaptor is fully engages with the second connector.

Upon still yet further urging of the first connector 41 toward the adaptor 47, the first connector 41 becomes fully engaged with the adaptor 47, as shown in FIG. 7. In this position the central contact 44 of the first connector 41 is in electrical communication with the central contact 56 of the second connector 53 via the central contact 63 of the adaptor 47, and the outer conductor 42 is in electrical communication with the outer conductor 54 of the second connector 53 via the outer conductor 48 of the adaptor 47 and the inner annular projection 45 of first connector 41. If the first connector 41 is pulled away from the second connector 53, the adaptor 47 will remain attached to the second connector 53 since the nub 60 of the adaptor 47 remains in the annular region 61 of the second connector 53.

Figure 8:
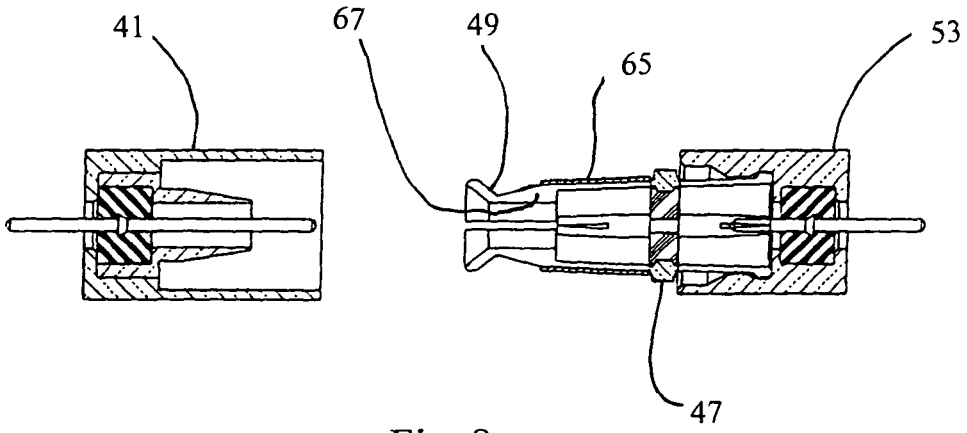
FIG. 8 is a cross-section side view of the third embodiment of the invention of FIG. 4 where the adaptor includes a layer foil sleeve, and the legs of the adaptor include added material.

FIG. 8 is a cross-section side view of the third embodiment of the invention of FIG. 4 where the adaptor 47 includes a foil sleeve layer 65, and the legs 49 of the adaptor 47 include added material 67. The foil sleeve layer 65 provides for improved electromagnetic interference performance. The added material 67 in the legs 49 of the adaptor 47 provides for improved impedance. The foil sleeve layer 65 is made of an electrically conductive material.

Figure 9:
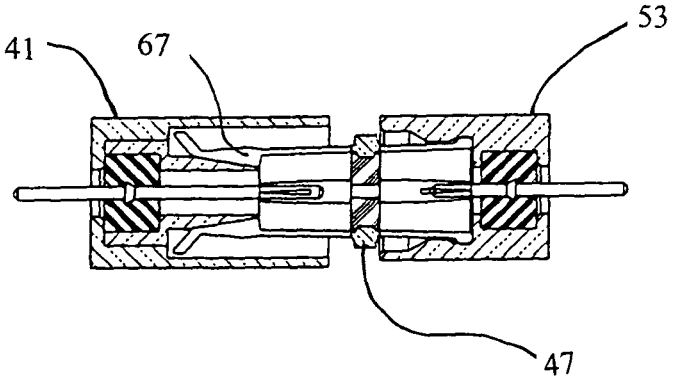
FIG. 9 is a cross-sectional side view of the adaptor of FIG. 8 having the legs which include the added material being fully engaged with the first connector and the second connector.

FIG. 9 is a cross-sectional side view of the adaptor 47 of FIG. 8 having the legs 49 which include the added material 67 being fully engaged with the first connector 41 and the second connector 53. The foil sleeve layer 67 is not shown in FIG. 9.

Figure 10:
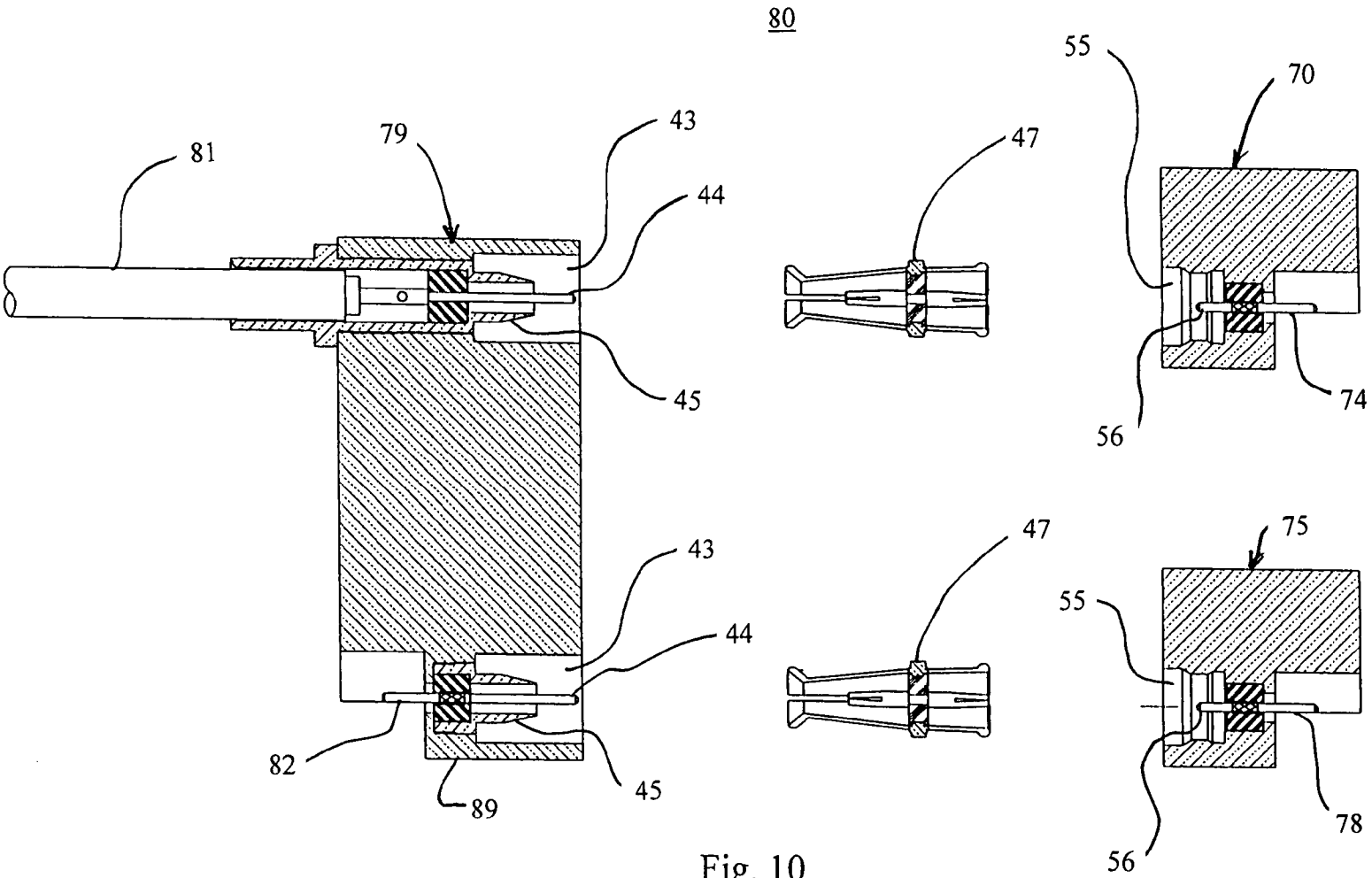
FIG. 10 is a cross-sectional side view of a fourth embodiment of the invention which is a cable connector not yet connected to a printed circuit board mounted connector via an adaptor, and the drawing also shows a printed circuit board connector not yet connected to another printed board mounted connector via an adaptor.

FIG. 10 is a cross-sectional side view of a fourth embodiment of the invention which is an assembly 80 consisting of a cable connector 79 not yet connected to a printed circuit board mounted connector 70 via an adaptor 47, and the drawing also shows a printed circuit board connector 89 not yet connected to another printed board mounted connector 75 via an adaptor 47. The printed circuit board mounted connector 70 includes a location 74 which is mountable to a printed circuit board, and a recess 55, and center contact 56 which is the same as the recess 55 and center contact 56 discussed in reference to the embodiment disclosed in FIG. 3. The printed circuit board mounted connector 75 includes a location 78 which is mountable to a printed circuit board, and, similar to the printed circuit board mounted connector 70, the connector 75 also includes recess 55, and center contact 56. The two adaptors 47 shown in FIG. 10 are the same as the adapter 47 shown in FIG. 3, thus the identification numbers remain the same.

The cable connector 79 also includes a portion which accepts a coaxial cable 81. The center conductor of the coaxial cable 81 is in electrical communication with the center contact 44. The outer shielding of the coaxial cable 81 is in electrical communication with the inner annular projection 45. The recess 43, center contact 44, and the inner annular projection 45 of FIG. 10 are the same as the same numbered features displayed in FIG. 3. The printed circuit board mounted connector 89 of the cable connector 79 includes a location 82 which is mountable to a printed circuit board.

Figure 11:
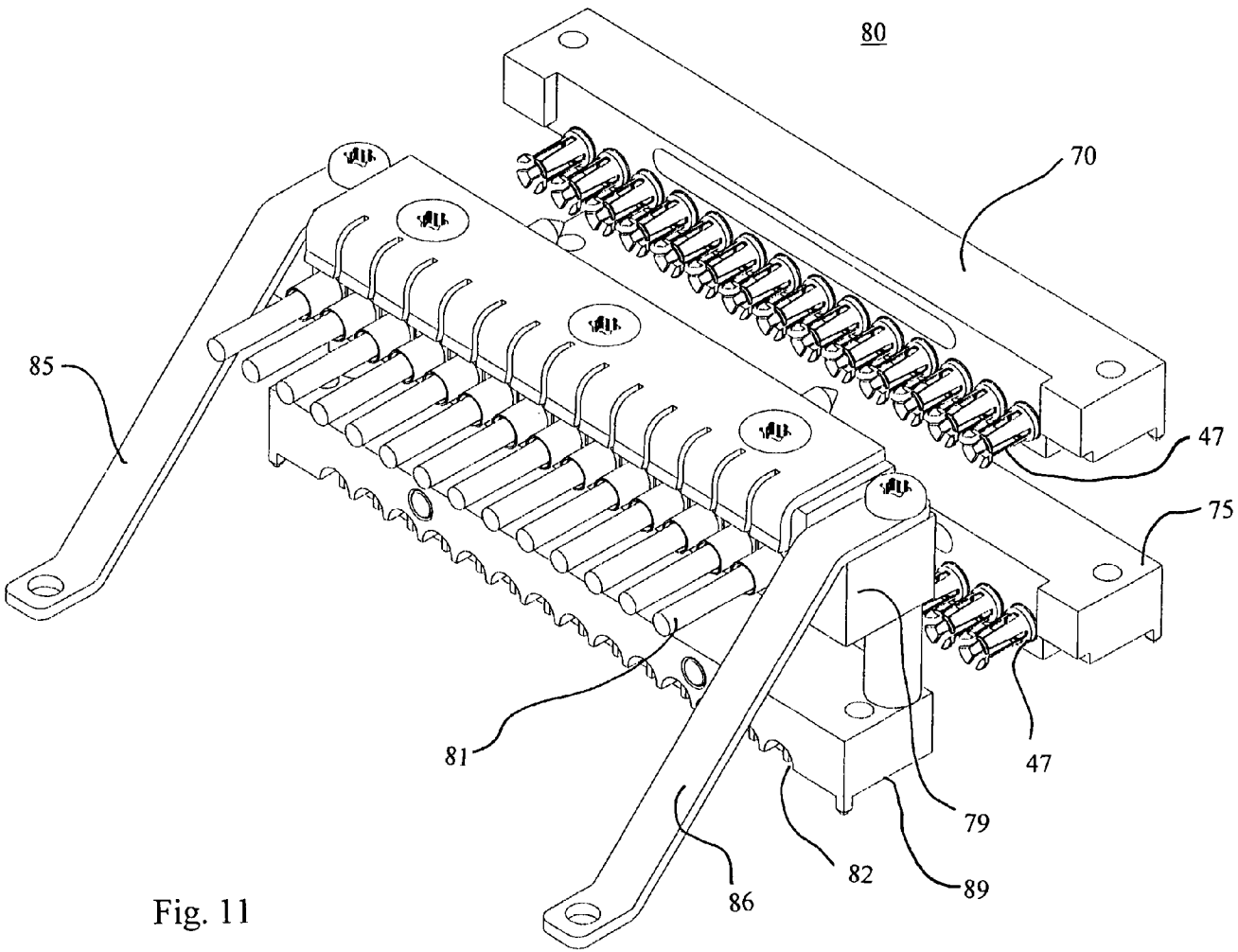
FIG. 11 is a perspective of the fourth embodiment of FIG. 10.

FIG. 11 is a perspective view of the assembly 80 of FIG. 10. Shown is the printed circuit board mounted connector 70 which includes fourteen adaptors 47. The printed circuit board mounted connector 75 also includes adaptors 47 engaged within its recesses 55. The cable connector 79 includes fourteen locations for accepting an equal number of coaxial cables 81, and fourteen locations 82 which are mountable for making an attachment for printed circuit board mounted connectors. Brackets 85, 86 are shown so as to secure the cable connector 79.

Figure 12:
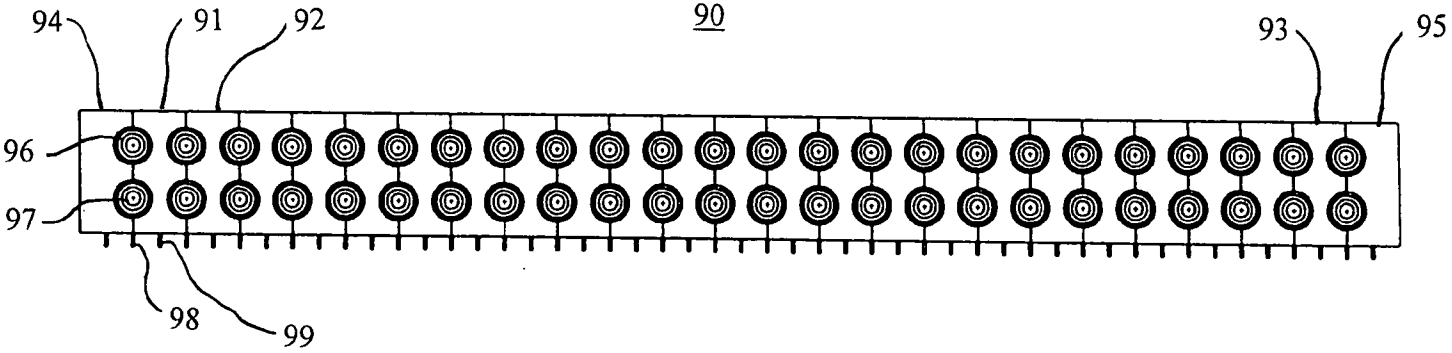
FIG. 12 is a front view of the fifth embodiment of the invention.

FIG. 12 is a front view of a fifth embodiment of the invention which is an assembly 90 consisting of numerous identical blocks 91, 92, 93, a left end block 94, and a right end block 95. Each of the blocks 91, 92, 93, 94, and 95 are pressed together to form the assembly 90. When two blocks are stacked together, the two blocks form the cavities for two connectors. Connectors 96, 97 are formed when left end block 94 is stacked and pressed against block 91. Each block 91, 92, 93 contains one half of the connector body cavity on each side. Left end block 94 and right end block 95 contain the cavity for half a connector on only one side. Contacts are shown in FIG. 12 one of which is identified as contact 98. Contact 98 is a center contact for one of the connectors which is created by stacking and pressing left end block 94 against block 91. Other contacts are ground contacts, one of which is identified as ground contact 99.

Figure 13:
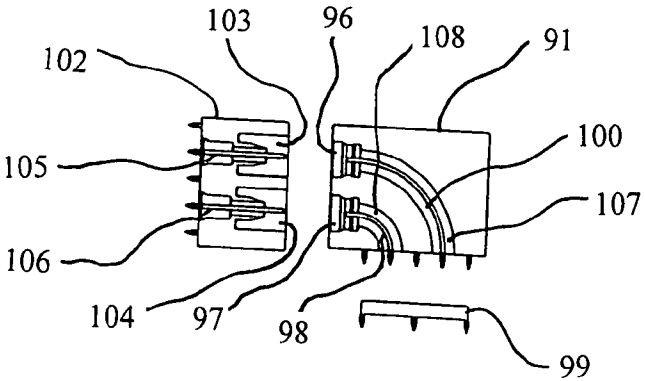
FIG. 13 are side views of one block of the connector of FIG. 12 and a side view of one block of a mating connector.

FIG. 13 is a side view of one of the block from FIG. 12, such as block 91, and also identified is a block 102, and a ground contact 99. When the assembly 90 of FIG. 12 is used, it is mated with a similarly constructed assembly consisting of blocks one of which is shown as block 102. Block 91 contains one half of a RF connector interface 96 and one half of a connector recess 107. An electrically conductive wire or contact 100 is shown in the connector recess 107. The connector interface at connector 96 is geometrically similar to the connector 53 displayed in FIG. 3. Block 91 also displays a second one half connector interface 97 and an associated one half of a connector recess 108 in which is shown a contact 98. The block 91, minus the contacts 100, 98, can be made of plastic and metallized or it can be made of a metallic material. Any suitable engineering material may be used. Ground contact 99 is shown as removed from block 91, but in use the ground contact 99 is assembled to block 91. Ground contact 91 is made of an electrically conductive material and is in electrical communication with block 91. The protruding contacts of the ground contact 99 are attachable to a printed circuit board.

The connector assembly constructed by assembling blocks similar to block 102 form an assembly with which the assembly 90 as shown in FIG. 12 can be mated via adaptors 47. Block 102 identifies one half of two connectors 103, 104 and in which is contained contacts 105, 106, respectively. Note that the geometry of connectors 103, 104 is substantially similar to connector 41 displayed in FIG. 3. Not shown is adaptor 47, but adaptor 47 would be used to make the eventual electrical connection between connector 96 and connector 103, and connector 97 and connector 104.

Figure 14:
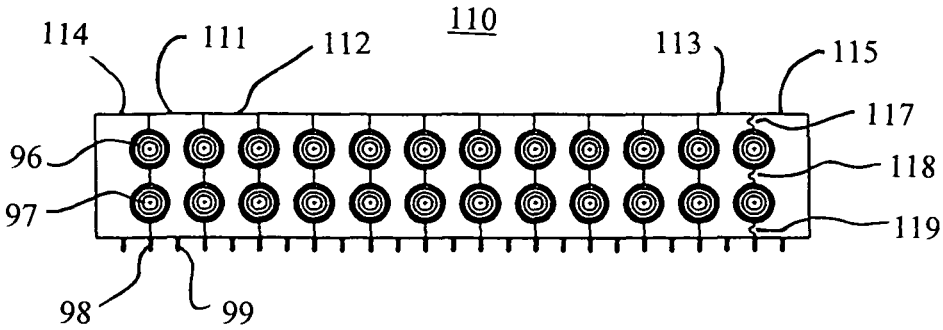
FIG. 14 is a front view of another version of the fifth embodiment of the invention.

FIG. 14 is a front view of another version of the fifth embodiment which shows assembly 110. Assembly 100 includes blocks 111, 112, 113, and left end block 114, and right end block 115. Similar to the assembly 90 shown in FIG. 12, each of the blocks 114, 111, 112, 113, 115 are pressed together to form the assembly 110. Once the assembly 110 is formed, connectors 96, 97 are also formed. Contact 98 and ground contact 99 are displayed. To keep the blocks together once the blocks have been pressed together, a series of ribs and grooves are employed. Ribs 117, 118, 119 are shown on right end block 115, and block 113 has a series of complementary grooves.

Figure 15:
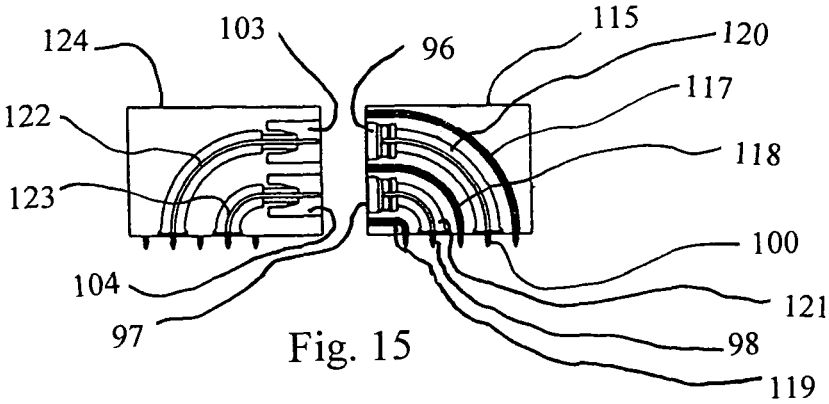
FIG. 15 are side views of one block of the connector of FIG. 15 and a side view of one block of a mating connector.

FIG. 15 is a side view of block 115 from FIG. 14, and also identified is a block 124. In practice the assembly 110 would mate with an assembly of blocks constructed of blocks 124 via the adaptor 47 which is not shown. Ribs 117, 118, 119 are shown. Also shown are split insulators or split sleeves 120, 121 which are used to keep the conductors 100, 98 from coming into electrical contact with the block 115. Block 115 includes connector halves 96, 97 which are geometrically similar to the connector 53 in FIG. 3. The complementary block 124 includes connector interfaces 103, 97 which are similar to connector 41 of FIG. 3.

Figure 16:
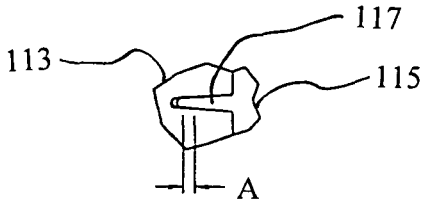
FIG. 16 is an expanded view of the press fit between two blocks of the connector of FIG. 14.
Figure 17:
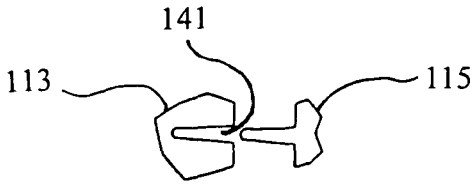
FIG. 17 is an expanded view of the rib and groove which make up the press fit before the two blocks are pressed together.

FIG. 16 is expanded partial view of the rib 117 of block 115 and the groove of block 113 of FIG. 14. During assembly, blocks 115, 113 are driven together along with the other blocks. The amount of the press fit is designated by the distance A. FIG. 17 shows the region of the press fit before blocks 113, 115 are pressed together, where the pressed together assembly is shown in FIG. 16. The groove of block 113 is identified as numeral 141. The coefficient of friction, width, length, and angle of the rib 117 and the groove 141 are designed as such so that once the blocks are pressed together, the blocks 113, 115 will not separate.

Figure 18:
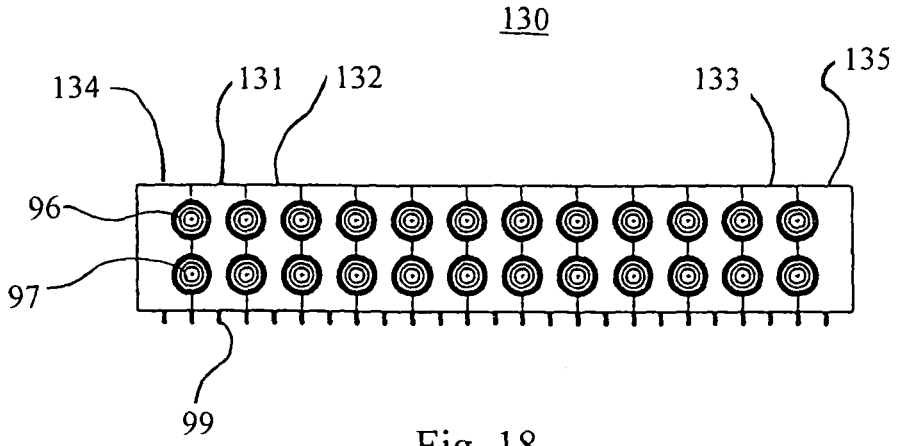
FIG. 18 is a front view of yet another version of the fifth embodiment of the invention.

FIG. 18 is another version of the fifth embodiment which shows assembly 130. Assembly 130 includes blocks 131, 132, 133, left end block 134, and right end block 135. The assembly of blocks forms connectors 96, 97. Ground contact 99 is also identified.

Figure 19:
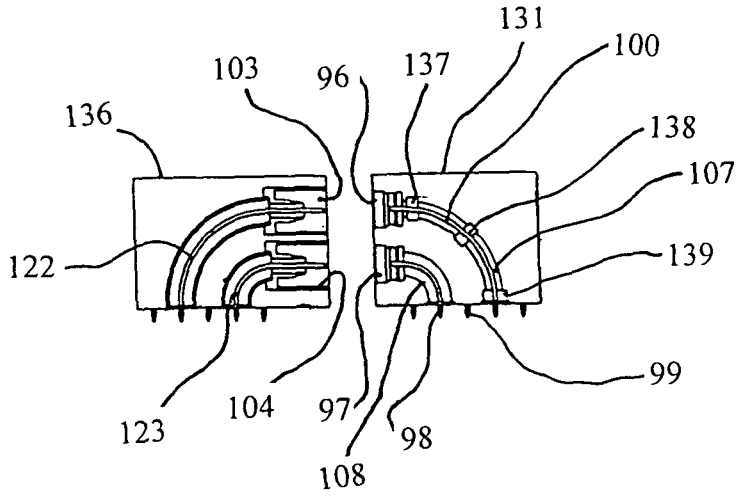
FIG. 19 are side views of one block of the connector of FIG. 18 and a side view of one block of a mating connector.

FIG. 19 is a side view of block 131 which identifies the connector recesses 107, 108. Inside connector recess 107 lies support beads 137, 138, 139. Support beads 137, 138, 139 support contact 100 so that contact 100 does not come into electrical contract with block 131 and the other block attached to block 131 so as to form the assembly 130. The connectors 96, 97 have the geometry of connector 53 of FIG. 3. The matting connector is formed of blocks, one of which is identified by numeral 136. The connectors 103, 104 of block 136 are geometrically similar to connector 41 of FIG. 3. Contacts 122, 123 of block 136 are identified.

Figure 20:
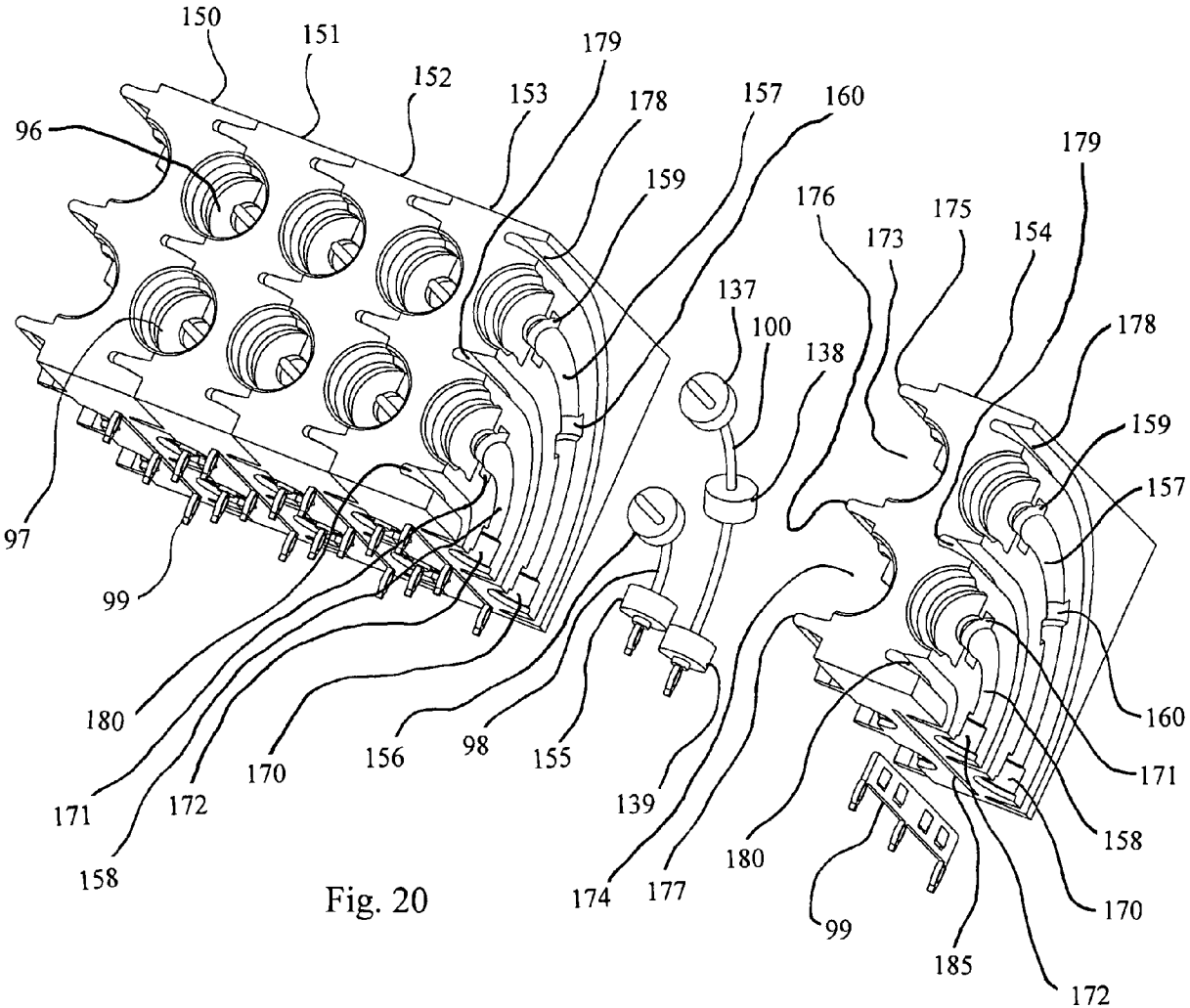
FIG. 20 is a perspective view of a connector assembly.

FIG. 20 is a perspective view of five blocks 150, 151, 152, 153 154, where the blocks are similar to the blocks identified in FIG. 19. Four of the blocks 150, 151, 152, 153 are shown in the assembled state and the fifth block 154 is shown as being ready to be pressed together with the remaining blocks. Left end blocks and right end blocks are not shown. When the blocks are assembled, it is shown that connectors 96, 97 are formed as is shown between blocks 150, 151. Similar to some of the other figures, ground contact 99 is identified. Also, retained between the blocks are contacts and support beads. Electrically conductive wires or contacts 98, 100 are shown between blocks 153, 154. Contact 100 is supported by three support beads 137, 138, 139, and contact 98 is supported by two support beads 156, 155. The support beads 137, 138, 139, 155, 156 are constructed of an electrically non-conductive material, or any other suitable engineering material having such characteristics.

Block 154 includes connector recesses 173, 174, 157, 158, ribs 175, 176, 177, grooves 178, 179, 180, support bead recesses 159, 160, 170, 171, 172, and ground contact recess 185. The ground contact 99 fits into the ground contact recess 185. Block 153 includes connector recesses 157, 158, grooves 178, 179, 180, and support bead recesses 159, 160, 170, 171, 172. Thus, blocks 150, 151, 152, 153, and 154 are identical. Support bead recess 159 retains support bead 137. Support bead recess retains 160 retains support bead 138. Support bead recess 170 retains support bead 139. Support bead recess 171 retains support bead 156. Support bead recess 172 retains support bead 155. When block 154 is secured with block 153, the contacts 100, 98, and support beads 137, 138, 139, 156, 155 are retained between the blocks 153, 154. The blocks 150, 151, 152, 153, 154 can be constructed of an electrically conductive material or they may be made of a polymer material which is metallized.

Figure 21:
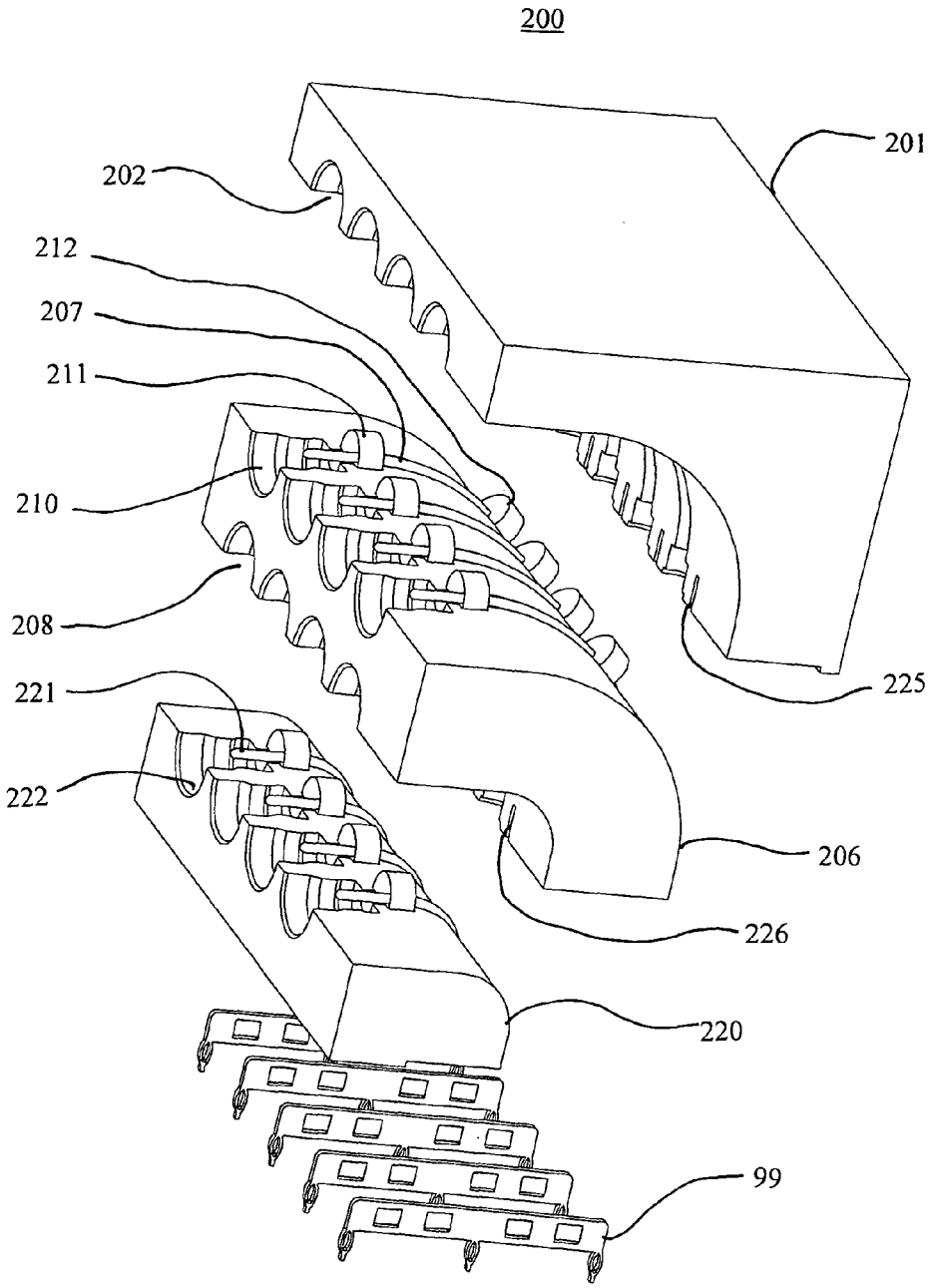
FIG. 21 is an exploded perspective view of another embodiment of the connector assembly.

FIG. 21 is an exploded perspective view of another embodiment of the invention which shows assembly 200. Assembly 200 includes blocks 201, 206, 220. Block 201 contains four connector recesses, one of which is identified as numeral 202. Block 206 contains four connector recesses on one side, one of which is identified as numeral 210. Block 206 also contains four connector recesses on another side, one of which is identified by numeral 208. Block 220 contains four connector recesses, one of which is identified as numeral 222. A contact 207 is supported by support beads 211, 212. The support beads are retained in support bead recesses found in connector recess 202 of block 201 and connector recess 210 of block 206. The remaining contacts and support beads adjacent to the contact 207 are retained in a similar manner. Likewise, contact 221 and the other contacts and support beads resting in the connector recesses of block 220 are retained between block 220 and block 206 when blocks 220, 206, 201 are secured together. The blocks 201, 206, 220 may be secured together by way of ribs and grooves. Block 201 includes a slot 225, block 206 includes a slot 226, and block 220 includes a slot for attaching ground contact 99.

The modular RF connector system can be configured for a variety of mounting styles and number of ports. Each connector is made up of a series of stackable blocks that contain half of the connector body cavity on each side. This allows the assembly of any shape of center contact and support insulator from the side. Each block has ribs on one side and grooves on the other side that lock the blocks together when stacked. This simplifies the connector and lends itself to lower cost fabrication methods for the body blocks. The connector interface is tapered to self-compensate for impedance change as the connector is unmated. This allows for greater axial float than normal without significant loss in performance.

One advantage of the invention is that it includes a self-compensating interface design which allows more axial float without impedance and performance degradation.

Another advantage is that the modular block design with locking ribs allow for a simple assembly of swept right angle contacts and support insulators from the side.

Still yet another advantage of the design is that the modular block design allows for the configuration of different style connectors in the same assembly.

It is envisioned that the concept can be used in applications of various block configurations for different mounting options. It is further envisioned that the ribs and grooves can have various shapes. Another application could be to stack the blocks vertically instead of horizontally. Additionally, single and multiple rows of interfaces of blocks can be used, and various connector interface styles can be utilized.

Obviously, numerous modifications and variations of the present invention are possible in light of the above teachings. It is therefore to be understood that within the scope of appended claims, the invention may be practiced otherwise than as specifically described herein.

The invention claimed is:

1. An electrical connector comprising:

a first center contact having a longitudinal axis, the first center contact being electrically conductive;

a first outer conductor, the first outer conductor being electrically conductive;

a first insulation material retained between the first center contact and the first outer conductor, the first insulation material made of a non-electrically conductive material;

a second center contact having a longitudinal axis, the second center contact being electrically conductive, and wherein the longitudinal axis of the second center contact is substantially perpendicular to the longitudinal axis of the first center contact;

a second outer conductor, the second outer conductor being electrically conductive;

a second insulation material retained between the second center contact and the second outer conductor, the second insulation material made of a non-electrically conductive material;

a spring in contact with the first outer conductor and the second outer conductor, and wherein the spring is a spring washer; and a flexible wire attached to the first center contact and the second center contact, and wherein the flexible wire conducts electricity, and wherein the first center contact is in electrical communication with the second center contact via the flexible wire, and wherein, when a force us applied to the first outer conductor, the force is reacted through the spring to the second outer conductor and not through the flexible wire, and, in response to the force, the spring is compressed.

2. An Electrical connector according to claim 1 wherein the connector conforms to a style of a 75 Ohm SMP connector.

3. A device comprising:

a first connector having a center contact, an outer conductor, and a layer of insulation material, the center contact and the outer conductor separated by the layer of insulation material, the outer conductor having an inner annular projection;

a second connector having a center contact, an outer conductor, and a layer of insulation material, the center contact and the outer conductor separated by the layer of insulation material, the outer conductor having an annular region formed within a recess of the outer conductor;

an adaptor having a central contact, an outer conductor, and a layer of insulation material retained between the central contact and the outer conductor, the outer conductor having a first leg and a second leg, the first leg having a contact surface and a flared end, the second leg having a nub, the central contact having two female contacts, a first female contact of the two female contacts has a contact surface, and wherein, when the adaptor engages the second connector, the nub of the second leg of the outer conductor of the adaptor engages the annular region formed in the recess of the outer conductor of the second connector so as to retain the adaptor by the second connector, and wherein, when the adaptor is introduced to the first connector, the flared end of the first leg of the outer conductor of the adaptor being aligned about the inner annular projection of the outer conductor of the first connector and the contact surface of the first leg of the outer conductor of the adaptor contacts the inner annular projection of the outer conductor of the first connector, and wherein, when the adaptor is further introduced toward the first connector, the contact surface of the first leg of the outer conductor remains in contact with the inner annular projection of the outer conductor of the first connector, and the contact surface of the first female contact of the two female contacts of the central conductor of the adaptor contacts the center contact of the first connector.

4. A device according to claim 3 wherein the center contact of the first connector, and the outer conductor of the first connector are made of a an electrically conductive material, and the layer of insulation material of the first connector is made of a non-electrically conductive material.

5. A device according to claim 4 wherein the center contact of the second connector, and the outer conductor of the second connector are made of an electrically conductive material, and the layer of insulation material of the second connector is made of a non-electrically conductive material.

6. A device according to claim 5 wherein the central contact of the adaptor, and the outer conductor of the adaptor are made of an electrically conductive material, and the layer of insulation material of the adaptor is made of a non-electrically conductive material.

7. A device according to claim 6 wherein at least one of the first connector and the second connector conforms to a style of a 75 Ohm SMP connector.

* * * * *